United States Patent [19]

Herbes et al.

[11] 4,306,872

[45] Dec. 22, 1981

[54] IMIDAZOLIDINONES IN A DURABLE PRESS PROCESS

[75] Inventors: William F. Herbes, Bridgewater; Chi-Fei Ling, Highland Park; William N. Nakajima, Somerville, all of N.J.

[73] Assignee: American Cyanamid Company, Stamford, Conn.

[21] Appl. No.: 112,775

[22] Filed: Jan. 17, 1980

[51] Int. Cl.[3] ..... D06M 13/34; B05D 3/02; C07D 233/30; C07D 403/30

[52] U.S. Cl. ..... 8/189; 8/195; 427/393.2; 427/394; 548/318; 548/319

[58] Field of Search ..... 8/573, 189, 195, 194; 427/393.2, 394; 548/318, 319

[56] References Cited

U.S. PATENT DOCUMENTS

| | | | |
|---|---|---|---|
| 2,777,857 | 1/1957 | Konig | 548/319 X |
| 3,091,617 | 5/1963 | Burris | 548/319 |
| 3,260,565 | 7/1966 | Beachem | 548/319 X |
| 3,304,312 | 2/1967 | Beachem | 548/319 |
| 3,627,556 | 12/1971 | Roth et al. | 427/393.2 X |
| 3,746,505 | 7/1973 | Bann et al. | 8/573 X |

*Primary Examiner*—Michael R. Lusignan
*Attorney, Agent, or Firm*—H. G. Jackson

[57] ABSTRACT

This invention relates to imidazolidinones and the use of the same to impart durable press properties to cellulosic textile materials. More particularly, it relates to novel imidazolidinones which release environmentally acceptable amounts of formaldehyde during the application and curing on said cellulosic textile materials.

7 Claims, No Drawings

IMIDAZOLIDINONES IN A DURABLE PRESS PROCESS

The most commonly used reactant to impart durable press appearance to cellulosic textile materials is 1,3-bis-(hydroxymethyl)-4,5-dihydroxy-2-imidazolidinone. During the processing steps of drying and curing, formaldehyde is released to the atmosphere. Also, when the finished fabric is stored, particularly under warm, humid conditions, formaldehyde is again released to the atmosphere. Since the presence of formaldehyde in the atmosphere is a matter of great concern because of possible harmful effects on human health, the minimization of its presence is constantly being sought.

The common textile finishing agents, including 1,3-bis(hydroxymethyl)-4,5-dihydroxy-2-imidazolidinone, rely on the reaction of methylol groups with cellulose to provide the cross-linking required to obtain durable press properties.

The U.S. Pat. No. 2,777,857 discloses the treatment of textiles with a compound of the formula:

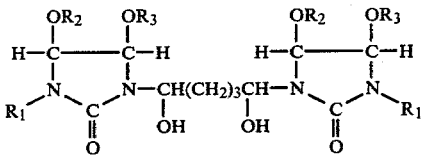

to impart crease resistance to the treated material.

In U.S. Pat. No. 3,260,565, Beachem discloses a method for creaseproofing cellulosic textile materials by the reaction of cellulose with a compound of the formula

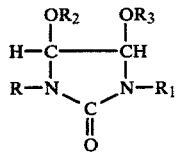

in which R and $R_1$ are selected from alkyl, phenyl, and substituted alkyl in which the substituents are cyano, carboxy, carbalkoxy, or carboxamide, and $R_2$ and $R_3$ are selected from hydrogen and lower alkyl. Although these compounds release no formaldehyde, they have the disadvantage of conferring only a moderate degree of wash-and-wear properties.

There is a need, therefore, for a product which can be applied to cellulose-containing textile materials to provide acceptable wash-and-wear properties with a concomitant reduction in the amount of formaldehyde released to the atmosphere on drying and curing.

In accordance with the present invention, there is provided a compound represented by formula (I)

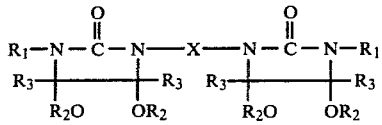

(I)

wherein $R_1$ is an alkyl radical of from 1 to 4 carbon atoms, or a hydroxy-substituted alkyl radical of from 2 to 4 carbon atoms, with the proviso that the hydroxy group is not on the alpha carbon atom; $R_2$ and $R_3$ are selected from hydrogen or an alkyl radical of from 1 to 4 carbon atoms; and X represents a radical selected from

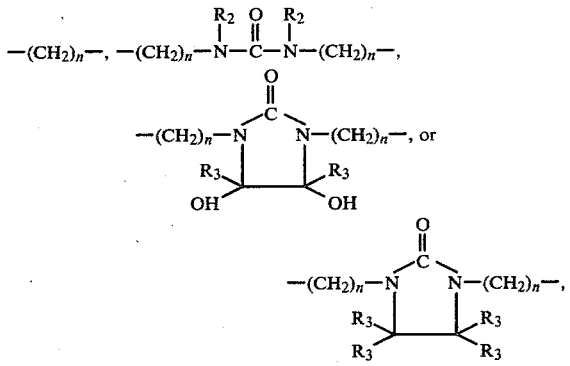

wherein $R_2$ and $R_3$ are as defined above and n is an integer from 1 to 4.

In accordance with the present invention, there is also provided a composition comprising an aqueous solution at least 2% by weight solids content of the compound of formula (I), and a suitable catalyst in an amount sufficient to be effective as a curing agent for the compound.

The invention also provides a process for imparting a durable press appearance to a cellulosic textile substrate material, comprising applying to the cellulosic textile material a composition of the present invention, and thereafter curing the treated substrate, the composition being applied in an amount and the curing being at a temperature, respectively, sufficiently high to impart a high order of resistance to creasing to the textile material.

The invention further provides cellulosic textile materials treated with the compositions and the processes of the same.

The compounds, compositions, and processes of the invention are useful in that they impart an acceptable durable press appearance to cellulosic materials treated therewith, particularly blends of polyesters and cotton, without releasing large amounts of formaldehyde before and during the necessary curing operation. For example, fabrics treated with the compounds and compositions of the present invention release only about 10–30% of the formaldehyde released by fabrics treated similarly with 1,3-bis(hydroxymethyl)-4,5-dihydroxy-2-imidazolidinone, a well-known durable press finishing agent. Thus, about a 70–90% reduction in the amount of formaldehyde released is achieved.

The reduction in the emission of formaldehyde is an important advantage particularly in post-cure durable press processing wherein the treated fabric is handled after the drying operation and prior to the final curing step.

The compounds of formula (I) wherein $R_2$ is hydrogen can be prepared by reacting an intermediate compound of formula (II)

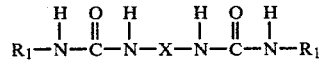

(II)

wherein $R_1$ and X are as previously defined, with a compound of formula (III)

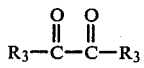

(III)

wherein $R_3$ is as previously defined. Subsequent reaction of this product with an alcohol of 1 to 4 carbon atoms under acidic conditions will provide the corresponding product wherein $R_2$ is an alkyl radical.

The intermediate compound of formula II wherein X is $—CH_2NHCONHCH_2—$ can be prepared by reacting about one molecular proportion of a compound of the formula:

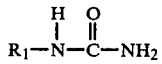

wherein $R_1$ is as defined above with about 1–1.2 molecular proportions of formaldehyde in an aqueous medium at a pH of about 2–3, and a temperature of about 45°–65° C., for about 1–3 hours, adding about one-half a molecular proportion of urea to the reaction mixture at a pH of about 2–3, and recovering the product which precipitates.

Examples of suitable intermediate compounds of formula (II) include the following:

1,1'-methylene bis[(3-hydroxypropyl)urea],
1,1'-methylene bis[(2-hydroxyethyl)urea],
1,1'-methylene bis(methylurea),
1,1'-methylene bis(ethylurea),
1,1'-methylene bis(isopropylurea),
1,1'-methylene bis(n-butylurea),
1,1'-1,4-butylene bis[(2-hydroxyethyl)urea],
1,1'-sec-butylidene bis[(2-hydroxyethyl)urea],
1,1'-methylene bis(n-propylurea),
1,1'-methylene bis[(3-hydroxypropyl)urea],
1,1'-[(ureylene)dimethylene]bis[(2-hydroxyethyl)urea],
1,1'-[(1,3-dimethylureylene)dimethylene]-bis[(2-hydroxyethyl)urea],
1,1'-[(2-oxo-1,3-imidazolidinylene)dimethylene]bis(methylurea),
1,1'-[(ureylene)dimethylene]bis(methylurea),
1,1'-[(2-oxo-1,3-imidazolidinylene)di-sec-butylene]-bis[(2-hydroxyethyl)urea], and the like.

The intermediate compound may be isolated or reacted in situ with the compound of formula (III). Examples of suitable compounds of formula (III) include the following:

glyoxal,
2,3-butanedione,
3,4-hexanedione,
5,6-decanedione, and
4,5-octanedione.

Examples of the compounds of formula (I) include the following:

1,1'-methylenebis[4,5-dihydroxy-3-(3-hydroxypropyl)-2-imidazolidinone],
1,1'-methylenebis[4,5-dihydroxy-3-(2-hydroxyethyl)-2-imidazolidinone],
1,1'-methylenebis(4,5-dihydroxy-3-methyl-2-imidazolidinone),
1,1'-methylenebis(4,5-dihydroxy-3-ethyl-2-imidazolidinone),
1,1'-methylenebis(4,5-dihydroxy-3-isopropyl-2-imidazolidinone),
1,1'-methylenebis(4,5-dihydroxy-3-n-butyl-2-imidazolidinone),
1,1'-1,4-butylenebis[4,5-dihydroxy-3-(2-hydroxyethyl)-2-imidazolidinone],
1,1'-sec-butylenebis[4,5-dihydroxy-3-(2-hydroxyethyl)-2-imidazolidinone],
1,1'-methylenebis[4,5-dihydroxy-3-(4-hydroxybutyl)-2-imidazolidinone],
1,1'-methylenebis(4,5-dimethyl-4,5-dihydroxy-3-methyl-2-imidazolidinone),
1,1'-methylenebis(4,5-dimethyl-4,5-dimethoxy-3-methyl-2-imidazolidinone),
1,1'-methylenebis[4,5-dimethoxy-3-(2-hydroxyethyl)-2-imidazolidinone],
1,1'-methylenebis[4,5-di-n-butoxy-3-(3-hydroxypropyl)-2-imidazolidinone],
1,1'-[(4,5-dihydroxy-2-oxo-1,3-imidazolidinylene)dimethylene]bis[4,5-dihydroxy-3-(2-hydroxyethyl)-2-imidazolidinone],
1,1'-[4,5-dimethoxy-2-oxo-1,3-imidazolidinylene)dimethylene]bis[4,5-dihydroxy-3-(2-hydroxyethyl)-2-imidazolidinone],
1,1'-[4,5-dihydroxy-2-oxo-1,3-imidazolidinylene)dimethylene]bis(4,5-dihydroxy-3-n-butyl-2-imidazolidinone),
1,1'-[(urylene)dimethylene]bis[4,5-dihydroxy-3-(2-hydroxyethyl)-2-imidazolidinone],
1,1'-[(1,3-dimethylurylene)dimethylene]bis[4,5-dihydroxy-3-(2-hydroxyethyl)-2-imidazolidinone],
1,1'-[(2-oxo-1,3-imidazolidinylene)dimethylene]bis(4,5-dihydroxy-3-methyl-2-imidazolidinone),
1,1'-[4,5-dimethoxy-2-oxo-1,3-imidazolidinylene)dimethylene]bis(4,5-dimethoxy-3-methyl-2-imidazolidinone),
1,1'-[4,5-dihydroxy-2-oxo-1,3-imidazolidinylene)di-sec-butylene]bis[4,5-dihydroxy-3-(2-hydroxyethyl)-2-imidazolidinone], and the like.

The compound of formula (I), a suitable catalyst, and any desirable processing aid, such as a surfactant, may be applied in an aqueous solution to the cellulosic textile material by any of the normal methods of application, such as padding, spraying, dipping, and the like.

The composition of the aqueous solution comprises a solution in water of a compound of formula (I) at a concentration of about 2% to 25%, preferably about 5% to 11%, based on the total weight of the solution and real catalyst at a concentration of about 0.3% to about 4%, preferably about 0.5% to about 1.5%, based on the total weight of the solution.

The amount of compound of formula (I) applied to the textile material should be about 1.5% to 11.0%, preferably about 3.5% to 5.5%, based on the weight of the textile material.

The amount of catalyst used should be about 5% to 18%, preferably about 7% to 12%, based on the weight of the compound of formula (I) used.

The treated fabric is then dried and cured by conventional methods used for common cellulose reactants to provide wrinkle resistance and shrink-proofing. Preferably, the treated fabric is dried and then cured at about 250° F. to 400° F. for about 15 seconds to 30 minutes.

Suitable catalysts include aluminum chloride, magnesium chloride, zinc nitrate, zinc fluoroborate, magnesium fluoroborate, and the like. The preferred catalysts are zinc fluoroborate, magnesium fluoroborate, and magnesium chloride.

The term "cellulosic textile material," as employed herein, is meant textile fibers, yarns, filaments, formed fabric, whether woven or non-woven, felted or otherwise formed, containing at least 10% by weight of a cellulose fiber prepared from cotton, rayon, linen, flax, and the like. These cellulosic textile materials may be blends containing other natural or synthetic fibers, such as wool, nylon, acrylic, and polyester fibers, and the like. The compounds and compositions of the invention have been found to be particularly advantageous on polyester/cotton blends. The preferred cellulosic textile material is a polyester/cotton blend containing about 50–80% by weight of cotton.

The following examples illustrate the invention. All parts are by weight unless otherwise indicated. Whiteness of the treated fabric was determined on a Hunterlab Model D-25 Color and Color-Difference Meter.

EXAMPLE 1

Preparation of 1,1'-Methylenebis(2-hydroxyethyl)Urea

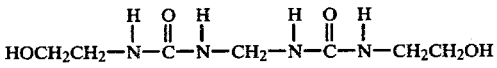

A mixture of 450 parts of 2-hydroxyethylurea, 230 parts of water, and 2.3 parts of concentrated sulfuric acid is stirred and heated to 50° C. to effect solution. Heating is then discontinued and 174.3 parts of 37.2% formaldehyde in water is added to the solution over a period of 20 minutes. The reaction mixture is cooled to room temperature, and the resulting white precipitate is collected by filtration and recrystallized twice from methanol to obtain a product which melts at 164°–165° C.

Calculated for $C_7H_{16}N_4O_4$: C,38.18%; H,7.32% ; N,25.44%. Found: C,38.02%; H,7.28%; N,24.96%.

EXAMPLE 2

Preparation of 1,1'-Methylenebis[4.5-dihydroxy-3-(2-hydroxyethyl)-2-imidazolidinone]

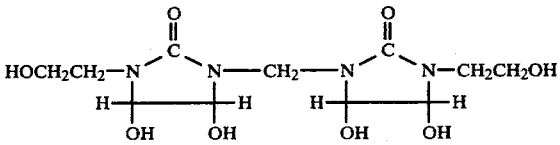

A mixture of 814 parts of 1,1'-methylenebis(2-hydroxyethyl)urea, 814 parts of water, and 894.6 parts of 40% glyoxal in water is heated to 60° C. to effect solution and stirred thereat for 0.5 hour. The pH of the solution is then adjusted to 6–7 with caustic soda and the mixture is stirred at 60° C. for an additional hour. The reaction mixture is then concentrated to remove most of the water. The syrupy product is then dissolved in a minimal amount of pyridine and the solution is drowned in acetone. The solid that precipitates is recovered by filtration, washed with acetone, and dried.

Calculated for $C_{11}H_{20}N_4O_8$: C,39.29%; H,5.99%; N,16.66%. Found: C,40.87%, H,5.37%; N,16.55%.

EXAMPLE 3

Preparation of 1,1'-[(Ureylene)dimethylene]bis(2-hydroxyethylurea)

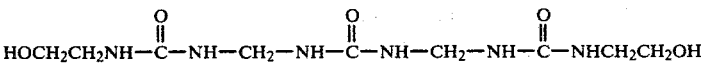

A mixture of 60 parts of 2-hydroxyethylurea and 46.5 parts of 37.2% formaldehyde in water is adjusted to a pH of 2–3 with concentrated sulfuric acid and heated at 50°–60° C. for one hour. Then, 18 parts of urea are added to the mixture, and the pH is maintained at 2 while the temperature is raised to 60° C. Within a few minutes a white solid starts to precipitate. This material is then collected by filtration, washed with methanol and dried.

Calculated for $C_9H_{20}N_6O_5$: C,36.98%; H,6.90%; N, 28.75%. Found: C,36.12%; H,6.47%; N, 29.30%.

EXAMPLE 4

Preparation of 1,1'-[(4,5-Dihydroxy-2-oxo-1,3-imidazolidinylene)dimethylene]bis[4,5-dihydroxy-3-(2-hydroxyethyl)-2-imidazolidinone]

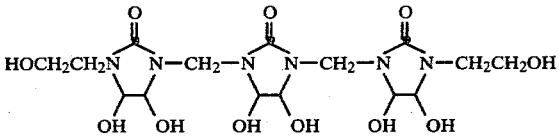

The procedure of Example 3 is followed in every detail to precipitate the white solid, 1,1'-[(ureylene)-dimethylene]bis(2-hydroxyethylurea). The addition of 103.6 parts of 40% glyoxal in water and heating the resulting mixture of 90° C. for 0.5 hour results in the formation of a light yellow-colored solution. The pH of the solution is then adjusted to 5–6 by the addition of sodium hydroxide. The solution is then concentrated and the syrupy product is recovered, and purified as described in Example 2, except that the solid recovered from drowning in acetone is subsequently triturated in isopropanol before drying.

Calculated for $C_{15}H_{20}N_6O_{11}$: C, 38.63%; H,5.62%; N,18.02%. Found: C, 39.77%; H,5.28%; N,18.12%.

EXAMPLE 5

A pad bath solution is prepared containing 20% of the product of Example 2, 1.09% of magnesium chloride, and 0.1% of aluminum chloride and 0.1% of Deceresol ® Surfactant NI conc. (American Cyanamid Co.) based on the weight of the solution. The solution is applied to 50/50 Dacron/cotton shirting by padding, one dip and one nip, using a padder pressure of two tons. The treated fabric is then dried and cured at 350° F. for 1.5 minutes to obtain a treated fabric containing about 11% real reactant based on the weight of the untreated fabric. The results obtained in comparison with a comparison application of 4,5-dihydroxy-1,3-bis(hydroxymethyl)-2-imidazolidinone (DMDHEU) are reported below.

| | | Un-treated | DMDHEU | Product of Example 2 |
|---|---|---|---|---|
| Durable Press Rating | 1 wash | 2.20 | 3.80 | 3.50 |
| Appearance Rating(1) | 5 washes | 2.10 | 3.75 | 3.40 |

-continued

| | | Un-treated | DMDHEU | Product of Example 2 |
|---|---|---|---|---|
| Whiteness[2] | initial | 83.2 | 82.1 | 80.3 |
| | 5 washes[1] | 85.7 | 83.7 | 83.6 |
| Yellowing to Scorch[3] | initial | 5.00 | 4.25 | 4.00 |
| | 1 chlorine wash[4] | 5.00 | 4.25 | 3.75 |
| Formaldehyde Release[5] | | — | 707 | 119 |
| Formaldehyde Release[6] | | — | 285 | 33 |

[1]AATCC Test Method 124-1975
[2]Model D-1 Color-Eye ® with "Z" filter, Instrument Development Laboratories (Attleboro, Mass.)
[3]Visual rating after scorching for 60 seconds at 365¼ F. with a Scorch Tester (Atlas Electric Devices Co., Chicago, Ill.) 5 = no yellowing; 4 = slight yellowing and 3 = noticeable yellowing.
[4]AATCC Test Method 114-1977.
[5]Parts per million released per gram of fabric using AATCC Test Method 112-1975.
[6]Parts per million on fabric per gram of fabric using Japanese Method (Ministry of Health and Welfare Ordinance No. 34, September 26, 1974).

EXAMPLE 6

In a similar manner a pad bath solution is prepared containing 15% by weight of the product of Example 2, 0.82% of magnesium chloride, 0.075% of aluminum chloride, and 0.1% of Deceresol ® Surfactant NI conc. based on the weight of the solution, and applied to 50/50 Dacron/cotton. A comparison application utilizing DMDHEU was also made. The results obtained are shown below.

| | | DMDHEU | Product of Example 2 |
|---|---|---|---|
| Durable Press Rating | 1 wash | 3.50 | 3.60 |
| Appearance Rating | 5 washes | 3.30 | 3.40 |
| Whiteness | initial | 81.7 | 81.0 |
| | 5 washes[1] | 82.8 | 83.7 |
| Yellowing to Scorch | initial | 4.50 | 4.25 |
| | 1 chlorine wash[4] | 4.25 | 4.25 |
| Formaldehyde Release[1] | | 413 | 87 |
| Formaldehyde Release[2] | | 242 | 28 |

[1]AATCC Test Method 112-1975.
[2]Japanese Method.

The results above show comparable physical properties are obtained with DMDHEU and the product of Example 2. The latter, however, releases much less formaldehyde.

EXAMPLE 7

A pad bath is prepared, as described in Example 5, containing the product of Example 2, and applied to bleached, mercerized cotton broadcloth (3.2 ounces per square yard), as described therein, except that the treated fabric is dried for 6 minutes at 225° F. and cured for 2 minutes at 340° F. A comparison application with DMDHEU is also carried out. The results obtained are shown below:

| | | Un-treated | DMDHEU | Pro-duct of Ex. 2 |
|---|---|---|---|---|
| Wrinkle Recovery[1] | | 188 | 301 | 258 |
| Tensile Strength | Warp | 77 | 23 | 39 |
| | Fill | 35 | 11 | 14 |
| Whiteness | Initial | 83.4 | 83.3 | 80.6 |
| | 5 washes | 89.5 | 81.6 | 83.9 |
| Yellowing to Scorch | Initial | 5.00 | 4.25 | 4.25 |
| | 1 chlorine wash | 5.00 | 4.25 | 4.25 |

[1]AATCC Test Method 66-1975.

These results show that although the wrinkle recovery obtained with the product of Example 2 is not so high as that of DMDHEU the other physical properties are comparable.

In the manner described above substituting 1.52% of magnesium fluoroborate for the magnesium chloride similar results are obtained.

EXAMPLE 8

A pad bath is prepared as described in Example 5, and applied to Vat Blue 6 dyed $80^2$ cotton print cloth from a pad bath having a pH of 3.7. A comparison application is also carried out utilizing DMDHEU and the shade change is evaluated initially and after one and five home washes. The results obtained are shown below:

| | Gray Scale Ratings | | |
|---|---|---|---|
| | Un-treated | Product of Ex. 2 | DMDHEU |
| Initially | 5 | 5 | 5 |
| After 1 Home Wash | 4–5 | 5 | 5 |
| After 5 Home Washes | 4–5 | 4–5 | 4–5 |

The results obtained show that the shade change with the product of Example 2 is equal to the shade change with DMDHEU.

EXAMPLE 9

A pad bath solution of the product from Example 4 is prepared as in Example 5, using 7.64% of the product of Example 4, 1% real zinc fluoroborate as the catalyst, and applied to 80×80 cotton poplin in a similar manner to obtain a treated fabric containing about 5.98% real reactant based on the weight of the untreated fabric. The results obtained with a comparison application of 4,5-dihydroxy-1,3-bis-(hydroxymethyl)-2-imidazolidinone (DMDHEU) are shown below.

| Treatment | Wrinkle Recovery | Initial Whiteness |
|---|---|---|
| Product of Example 4 | 253° | 61.4 |
| DMDHEU | 294° | 76.7 |
| Untreated | 169° | 82.2 |

We claim:

1. A process for imparting a durable press appearance to a cellulosic textile substrate material, comprising applying to said cellulosic textile material a composition comprising an aqueous solution of at least 2% by weight solids content of a compound represented by formula (I)

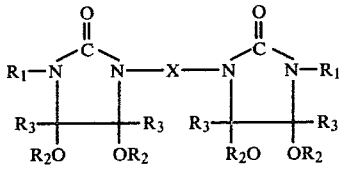

wherein $R_1$ is an alkyl radical of from 1 to 4 carbon atoms, or a hydroxy-substituted alkyl radical of from 2 to 4 carbon atoms, with the proviso that the hydroxy group is not on the first carbon atom; $R_2$ and $R_3$ are selected from hydrogen or an alkyl radical of from 1 to 4 carbon atoms; and X represents a radical selected from

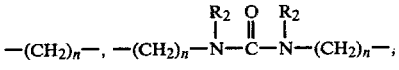

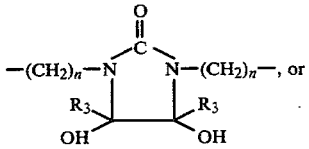

-continued

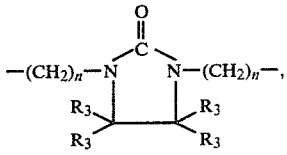

and a suitable catalyst in an amount sufficient to be effective as a curing agent for said compound and thereafter curing the treated substrate, said composition being applied in an amount and said curing being at a temperature, respectively, sufficiently high to impart a high order of resistance to creasing to said textile material.

2. A process according to claim 1 wherein X in formula I is $—CH_2—$.

3. A process according to claim 2 wherein said composition comprises a solution in water wherein the compound of formula I is at a concentration from about 2% to about 25%, based on the weight of said composition, and a catalyst selected from magnesium chloride, zinc fluoroborate, or magnesium fluoroborate at a concentration from about 0.3% to about 4%, based on the weight of said composition, said composition being applied to said cellulosic textile material to deposit said compound of formula I in an amount from about 1.5% to about 11.0% based on the weight of said textile material, drying the treated substrate and thereafter curing the same at a temperature ranging from about 250° F. to about 400° F. for about 15 secs–30 minutes.

4. The process according to claim 1 wherein said cellulosic textile material is a polyester/cotton fabric.

5. The process according to claim 1 wherein said cellulosic textile material is a cotton fabric.

6. The treated polyester/cotton fabric of claim 4.

7. The treated cotton fabric of claim 5.

* * * * *